US006191644B1

(12) United States Patent
Srinath et al.

(10) Patent No.: US 6,191,644 B1
(45) Date of Patent: Feb. 20, 2001

(54) STARTUP CIRCUIT FOR BANDGAP REFERENCE CIRCUIT

(75) Inventors: Bangalore Kodandaram Srinath, Bangalore (IN); Scott E. Smith, Sugar Land, TX (US)

(73) Assignee: Texas Instruments Incorporated, Dallas, TX (US)

( * ) Notice: Under 35 U.S.C. 154(b), the term of this patent shall be extended for 0 days.

(21) Appl. No.: 09/209,655

(22) Filed: Dec. 10, 1998

(51) Int. Cl.[7] ..... G05F 1/10
(52) U.S. Cl. ..... 327/539; 327/142
(58) Field of Search ..... 327/539, 143, 327/142, 198

(56) References Cited

U.S. PATENT DOCUMENTS 4,947,061 * 8/1990 Metz et al. ..... 326/73
6,002,243 * 12/1999 Marshall ..... 323/313

* cited by examiner

*Primary Examiner*—Toan Tran
*Assistant Examiner*—Hiep Nguyen
(74) *Attorney, Agent, or Firm*—Wade James Brady III; Frederick J. Telecky Jr.

(57) ABSTRACT

A bandgap reference circuit (10) with improved startup circuitry is disclosed. The bandgap reference circuit (10) includes a startup node (NBIAS) that is connected to the gates of n-channel MOS transistors (38*n*, 39*n*) in first and second conduction legs of a current mirror. A series of inverters (51, 53, 55) turn on a transistor (50) that is connected between a precharge node (TO) and the startup node (NBIAS) in response to a signal (RID) indicating recent power-up of a power supply voltage ($V_{dd}$). A capacitor (60) is also provided, and which is discharged upon power-down. The capacitor (60) is connected to the gate of a p-channel transistor (70) that has its source/drain path connected between the precharge node (TO) and the startup node (NBIAS), and that is turned on upon power-up, even if the power-up signal (RID) is not generated, thus ensuring initiation of the bandgap reference circuit (10).

15 Claims, 3 Drawing Sheets

STARTUP CIRCUIT FOR BANDGAP REFERENCE CIRCUIT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention is in the field of integrated circuits, and is more specifically directed to reference voltage circuits therein.

As is well known in the field, many modern integrated circuits incorporate voltage detection and comparison circuits for comparing the voltages applied to or generated within the circuits against a reference level. Many modem integrated circuits utilize on-chip voltage regulators to generate internal bias voltages that are stable over variations in temperature, power supply voltage, and processing parameters. Additionally, voltage detection and comparison circuits are sometimes used in determining the operating range within which an externally applied power supply voltage is biased in modern integrated circuits that can operate in either a low power supply voltage range (e.g., 3.3 volts±10%) or a higher power supply voltage range (e.g., 5 volts ±10%). Each of these types of circuit require a stable reference voltage to effect proper comparison and detection, as the comparisons carried out by these circuits are against absolute voltage levels (rather than as a differential comparison).

Bandgap reference circuits constitute one popular type of conventional reference voltage circuit. In general, bandgap reference circuits produce a reference voltage that depends upon two circuit elements with complementary temperature coefficients. Typically, the bandgap reference voltage depends upon the base-emitter voltage of a bipolar transistor (which may be a parasitic bipolar device in integrated circuits that are fabricated according to metal-oxide-semiconductor, or MOS, technologies) and also upon either the resistance value of a diffused resistor or upon a MOS transistor threshold voltage. Since the base-emitter voltage of a bipolar device has a temperature coefficient that is opposite from that of either of a differential base-emitter voltage of two bipolar transistors, a reference voltage that is generated from the combination of these characteristics can be quite stable over temperature. Accordingly, bandgap reference circuits are widely used in modem integrated circuits that require a stable reference voltage for internal voltage detection and comparisons.

Particularly in integrated circuits that detect the levels of the applied power supply voltage, it is important that the reference voltage circuits rapidly begin operation upon power-up of the integrated circuit. If a reference voltage circuit does not rapidly begin operation on power-up, it is possible for the integrated circuit to enter an unstable or indeterminate operating mode. For example, delayed power-up of the reference circuit may cause the incorrect detection of the power supply voltage operating range and, as a result, misconfiguration of internal circuits that are to be configured according to the power supply level. Other failures due to delayed generation of a reference voltage are well known in the art.

Accordingly, the use of power-up detection circuits to generate a signal upon power-up of the integrated circuit, and the application of these signals to initiate the operation of reference voltage circuits upon power-up, is known in the art. Referring now to FIG. 1, the construction and operation of an example of a conventiolal bandgap reference circuit in combination with a startup circuit for rapidly initiating operation of the bandgap reference circuit, according to the prior art, will now be described by way of background.

Bandgap reference circuit 10 in this conventional example is arranged as multiple current mirror legs, each including a bipolar transistor. The output leg of bandgap reference circuit 10 includes the series connection of the source/drain paths of p-channel transistors 12*p* and 14*p*; the source of transistor 12*p* is biased to power supply voltage $V_{dd}$, and the drain of transistor 14*p* is connected to a resistor divider of resistors 16, 18. Resistors 16, 18 (as well as the other resistors in bandgap reference circuit 10), are preferably diffused resistors formed in p-type regions in the substrate of the integrated circuit within which bandgap reference circuit 10 is realized. P-n-p bipolar transistor 20 has its emitter connected to resistor 18, at the opposing end of the resistor divider, and has its base and collector at ground. The output of bandgap reference circuit 10 on line VREF is taken from the node between resistors 16, 18 in the resistor divider of this leg.

Two additional current mirror legs in bandgap reference circuit 10 are also provided. The middle leg includes the series source/drain connection of p-channel transistors 22*p*, 24*p*, with the source of transistor 22*p* at power supply voltage $V_{dd}$ and the drain of transistor 24*p* connected to one side of resistor 26. In this middle leg, n-channel transistor 28*n* has its source/drain path connected between resistor 26 and resistor 29. P-n-p bipolar transistor 30 has its emitter connected to resistor 29, and its base and collector at ground. The first leg of bandgap reference circuit 10 also includes series source/drain connection of p-channel transistors 32*p*, 34*p*, with the source of transistor 22*p* at power supply voltage $V_{dd}$. In this leg, the drain of transistor 34*p* is connected to the drain of n-channel transistor 38*n* at node NBIAS; the source of transistor 38*n* is connected to the emitter of p-n-p bipolar transistor 40, which has its base and collector at ground.

The current mirroring in bandgap reference circuit 10 arises from the interconnection of the gates of transistors in the various legs. In this example, the gates of p-channel transistors 12*p*, 22*p*, 32*p* are connected in common at node PBIAS1, which is connected to the drain of transistors 24*p*. The gates of p-channel transistors 14*p*, 24*p*, 34*p* are connected in common at node PBIAS2, which is connected to the node between resistor 26 and the drain of transistor 28*n*. As illustrated in FIG. 1, the body nodes of transistors 14*p*, 24*p*, 34*p* are biased to their respective sources (rather than to $V_{dd}$, as is the case for transistors 12*p*, 22*p*, 32*p*). The voltages established at nodes PBIAS1, PBIAS2 may be forwarded to other circuits in the integrated circuit within which bandgap reference circuit is deployed, if desired, as illustrated in FIG. 1. The gates of transistors 28*n*, 38*n* are connected in common at node NBIAS. Additionally, capacitor 39 is connected to node NBIAS, to provide common mode noise rejection relative to any noise that may appear at the bases of bipolar transistors 20, 30, 40.

In normal operation, bandgap reference circuit 10 uses the mirrored currents to establish a stable voltage at node VREF. Current that is conducted through the first leg of transistors 32*p*, 34*p*, 38*n*, 40 is mirrored through the second leg of transistors 22*p*, 24*p*, 28*n*, 30, and resistors 26, 29. The voltages that are established at nodes PBIAS1, PBIAS2 by this current mirror operation similarly bias transistors 12*p*, 14*p*, establishing a current through the output leg of transistors 12*p*, 14*p*, 20 with resistors 16, 18. The voltage drop across resistor 18 and transistor 20 generated by this current sets the output reference voltage on line VREF. The voltage on line VREF thus depends upon the base-emitter voltage of transistors 20, 30, 40, and upon the resistance of diffused resistors 18 and 29. Because the temperature coefficient of the base-emitter voltage of the bipolar transistors varies in an opposite fashion from the resistance of diffused resistors 16, 18, 26, 29, the output reference voltage at line VREF will be relatively stable over temperature, as is known in the art.

The normal operation of bandgap reference circuit 10 described hereinabove commences upon the conduction of current through the first leg of the current mirror, namely through the source/drain paths of transistors 32*p*, 34*p*, 38*n*, and through bipolar transistor 40. According to the conventional arrangement of FIG. 1, bandgap reference circuit 10 initiates such conduction through the operation of startup circuitry that biases node NBIAS upon receipt of an active high signal on line RID from power-up reset circuitry elsewhere in the integrated circuit, indicating the power-up of power supply voltage $V_{dd}$.

Line RID is applied to a series of inverters 51, 53, 55, with the output of inverter 55 applied to the gate of p-channel transistor 50. Transistor 50 has its source/ drain path connected between node NBIAS and the drain of p-channel transistor 44*p* at node TO. Transistor 44*p* has its source/drain path connected in series with that of p-channel transistor 42*p* between power supply voltage $V_{dd}$ and node TO; the gate of transistor 42*p* is at ground, while the gate of transistor 44*p* is connected to one plate of capacitor 60, the other plate of which is at ground. P-channel transistor 48*p* has its drain connected to node TO, its source connected to power supply voltage $V_{dd}$, and its gate driven by the output of inverter 53. Node TO is also connected to the gate of p-channel transistor 56*p*, the source of which is connected to capacitor 60 and the drain of which is at ground. P-channel transistors 52*p*, 54*p* have their source/drain paths connected in series between power supply voltage $V_{dd}$ and the source of transistor 56*p*, and have their gates controlled by the bias voltages PBIAS1, PBIAS2, respectively.

The operation of this circuitry in initiating the operation of bandgap reference circuit 10 in response to a power-up event will now be described. Prior to receiving the power-up signal, line RID is inactive low, and as such the gate of transistor 50 is at the level of power supply voltage $V_{dd}$ (from inverter 55), and transistor 50 is off. Transistor 48*p* is turned on by the low level at the output of inverter 53, and as such connects the level of power supply voltage $V_{dd}$ to node TO. At this time, capacitor 60 is discharged, generally through the tanks or wells of transistors 54*p*, 56*p*, to a voltage that is at least a p-channel threshold voltage below power supply voltage $V_{dd}$. As a result, transistor 44*p* is turned on, permitting the level of power supply voltage $V_{dd}$ to also be applied to node TO through transistors 42*p*, 44*p*. Of course, prior to receiving the power-up signal on line RID, the level of power supply voltage $V_{dd}$ will be ramping from a low level toward its eventual high voltage. At this time, no conduction is occurring through any of the current mirror legs of bandgap reference circuit 10.

Upon the power-up detection circuit (not shown) issuing an active pulse on line RID in response to detecting the powering-up of power supply voltage $V_{dd}$, this high level pulse will ripple through inverters 51, 53, 55, with the output of inverter 55 driving a low logic level at the gate of transistor 50, turning it on. The level of power supply voltage $V_{dd}$ that is present at node TO (through operation of transistors 42*p*, 44*p*, 48*p*) is then applied to node NBIAS, turning on transistor 38*n* and initiating conduction through the first current mirror leg of bandgap reference circuit 10. The current conducted through transistors 32*p*, 34*p*, 38*n*, 40 is then mirrored by the other legs of bandgap reference circuit 10, resulting in the establishment of the reference voltage on line VREF. Bias voltages are also established on lines PBIAS1, PBIAS2, as noted above.

After power up, the pulse on line RID ends, returning the output of inverter 55 back to a high level, turning off transistor 50 so that the voltage at node NBIAS is determined solely by the operation of the current mirror in bandgap reference circuit 10. The end of the pulse on line RID, via inverter 53, also turns on transistor 48*p*, forcing node TO high and turning off transistor 56*p*. Additionally, the establishment of bias voltages on lines PBIAS1, PBIAS2 cause transistors 52*p*, 54*p* to conduct, in a similar manner as in the current mirror legs of bandgap reference circuit 10. This conduction raises the voltage at capacitor 60 (transistor 56*p* being off), which turns off transistor 44*p*, to prevent parasitic conduction.

This operation has been observed to rapidly turn on bandgap reference circuit 10 upon power-up, with startup occurring within a few microseconds from the pulse on line RID. However, power-up situations have been observed in which the power-up detection circuit does not respond and generate the active pulse on line RID. Such situations include the powering-up of the circuit after a brief power-down interval. In addition, because the ramp rate of power supply voltage $V_{dd}$ on power-up is not specified, wide variations in actual system powering-up can occur, not all of which are always detectable by conventional power-up detection circuits. Without receiving an active power-up detection pulse on line RID, bandgap reference circuit 10 will not quickly establish a reference voltage on line VREF, as only parasitic conduction will at most be present through the current mirror legs if the startup circuitry does not initiate conduction. This parasitic conduction is insufficient to initiate operation of bandgap reference circuit 10 for many milliseconds, if not seconds, after power-up of power supply voltage $V_{dd}$. This delayed operation in the generation of the reference voltage on line VREF can result in the integrated circuit entering an indeterminate or incorrect state. This can cause not only erroneous operation of the integrated circuit, but can also, in some circumstances, result in catastrophic failure of the device.

BRIEF SUMMARY OF THE INVENTION

It is therefore an object of the present invention to provide a circuit and method of operating the same which initiates operation of a reference voltage circuit in the absence of a power-up detection signal.

It is a further object of the present invention to provide such a circuit and method which may be efficiently implemented in an integrated circuit, with minimal chip area required.

It is a further object of the present invention to provide such a circuit and method in which existing circuit elements are used to a large degree.

Other objects and advantages of the present invention will be apparent to those of ordinary skill in the art having reference to the following specification together with its drawings.

The present invention may be implemented into startup circuitry for a bandgap reference circuit having a startup node at which a power-up indication signal generally applies a startup voltage. A capacitor is provided which is discharged prior to power-up; this discharged voltage is used to turn on a pass transistor that forwards a precharge voltage to the startup node in the absence of the power-up indication signal.

DETAILED DESCRIPTION OF THE INVENTION

Figure 1:
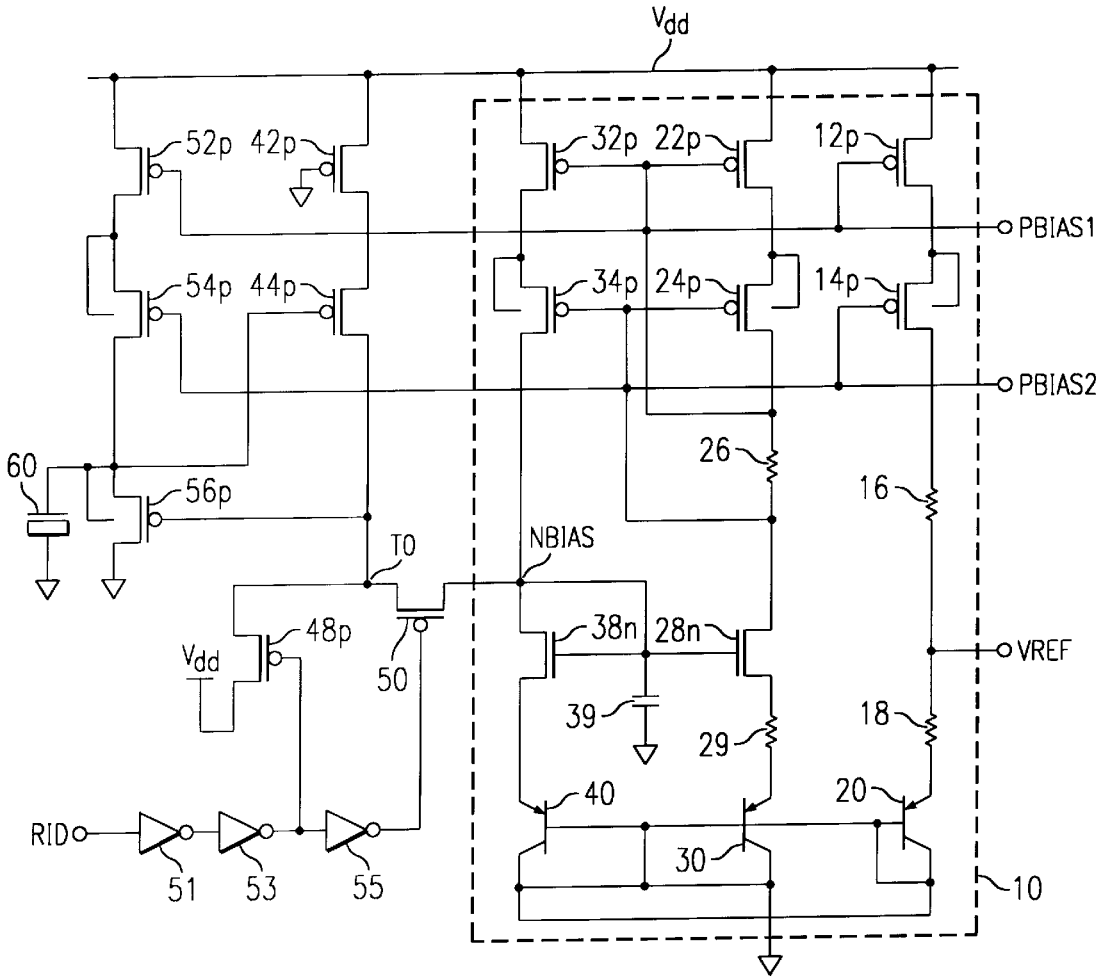
FIG. 1 (PRIOR ART)
FIG. 1 is an electrical diagram, in schematic form, of a conventional bandgap reference circuit with startup circuitry.
Figure 2:
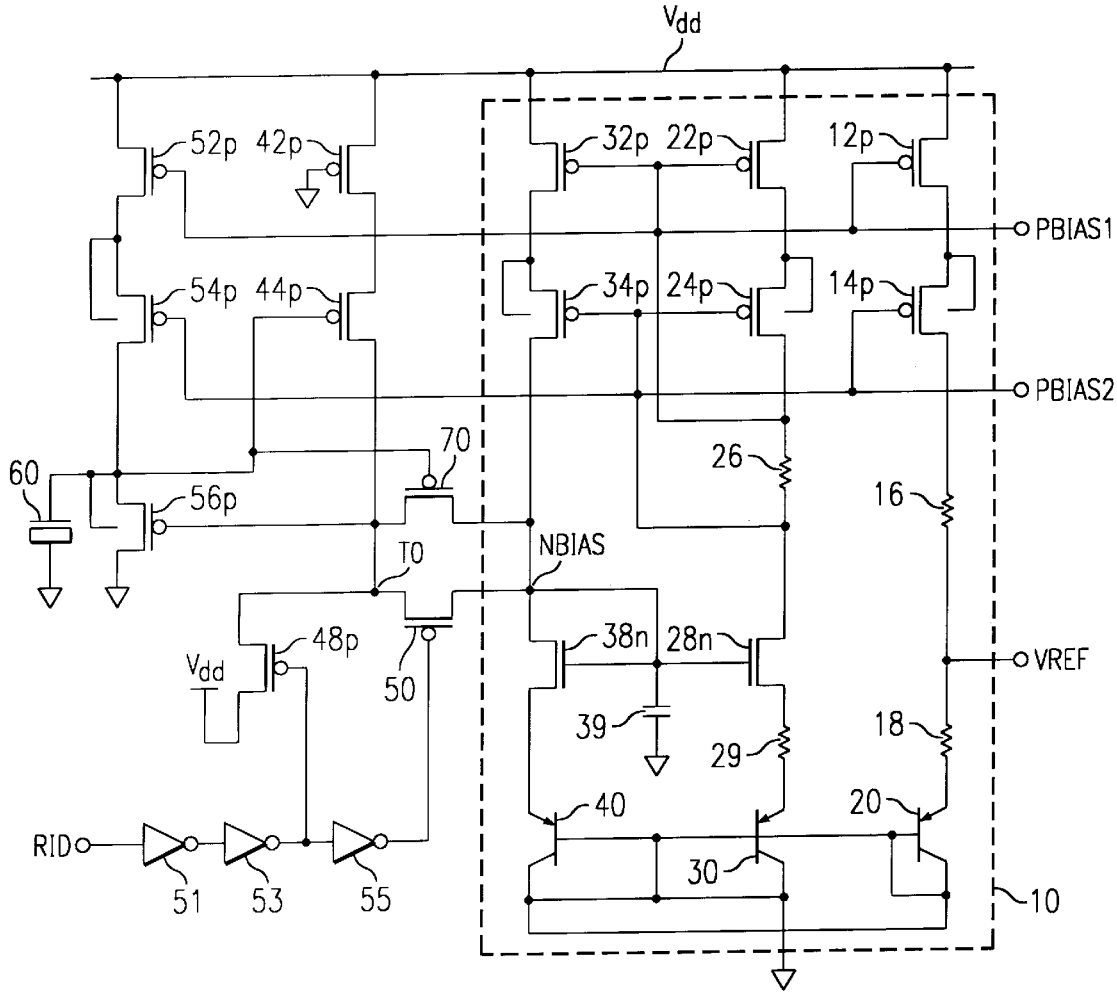
FIG. 2 is an electrical diagram, in schematic form, of a bandgap reference circuit and startup circuitry according to the preferred embodiment of the invention.

Referring now to FIG. 2, the construction and operation of a voltage reference circuit according to the preferred embodiment of the present invention will now be described in detail. Like elements in the circuit of FIG. 2 as in the conventional circuit of FIG. 1 will be referred to by the same reference numerals, for clarity and convenience.

While the preferred embodiment of the invention will be described hereinbelow in connection with the startup of a bandgap reference circuit, as illustrated in FIG. 2, it is of course contemplated that the present invention may provide benefits in other reference voltage circuit realizations, as well as in other circuits which require reliable initiation upon power-up. It is contemplated that those of ordinary skill in the art having reference to this specification will be readily able to implement the present invention in such alternative circuits.

As illustrated in FIG. 2, the circuit according to the preferred embodiment of the invention includes bandgap reference circuit 10 as before, which generates an output reference voltage on line VREF from the voltage divider of resistors 16, 18 in the third current mirror leg, based upon a current conducted therethrough that mirrors the currents in the first and second current mirror legs. Also as before, the operation of bandgap reference circuit 10 is initiated by the application of a relatively high voltage at node NBIAS, which is at the gate and drain of n-channel transistor 38*n* in the first current mirror leg; with transistor 38*n* turned on to permit conduction therethrough, mirrored current will also be conducted in the second and third legs of bandgap reference circuit 10, generating the output reference voltage on line VREF as described above.

The circuit of FIG. 2 according to the preferred embodiment of the invention also includes the startup circuitry described hereinabove, by way of which an active high level pulse on line RID turns on transistor 50, thus applying a precharged high voltage at node TO to the gate and drain of transistor 38*n*, initiating conduction as described hereinabove. Transistor 50 is turned off upon completion of the pulse on line RID, isolating the startup circuitry from bandgap reference circuit 10 as described above.

Normal operation of the circuitry of FIG. 2 according to the preferred embodiment of the invention, and the initiation of such operation in response to an active high pulse or signal on line RID from a power-on reset or other power-up detection circuit, are identical to that described hereinabove relative to FIG. 1.

According to the present invention, however, startup of bandgap reference circuit 10 is enabled even in the event that a power-up indication pulse is not generated on line RID, for whatever reason. According to the preferred embodiment of the present invention, p-channel transistor 70 is provided, having its source/drain path connected between node TO and node NBIAS, and having its gate connected to capacitor 60. As will be described in further detail hereinbelow, transistor 70 is made conductive by the voltage across capacitor 60 so as to apply a precharged power supply voltage $V_{dd}$ to node NBIAS, turning on transistor 38*n* in bandgap reference circuit 10 even in the absence of an active high pulse on line RID. While a single transistor 70 is illustrated in FIG. 2, it will of course be appreciated that multiple transistors 70 may be provided in parallel, as necessary to provide the appropriate drive of node NBIAS, especially considering the presence of common mode noise rejection capacitor 39.

The operation of the circuitry of FIG. 2 in initiating operation of bandgap reference circuit 10 in the absence of a pulse on line RID upon power-up will now be described in detail. After power-down, and prior to initiation of operation of bandgap reference circuit 10, line RID is low, and the gate of transistor 50 is at the level of power supply voltage $V_{dd}$ (from inverter 55) and is therefore held off. Transistor 48*p* is on by the low level at the output of inverter 53, precharging node TO to the level of power supply voltage $V_{dd}$; node TO will thus substantially follow the rising level of power supply voltage $V_{dd}$. Also at this time, capacitor 60 has been discharged to a voltage that is at most a p-channel threshold voltage above ground, such discharge taking place primarily through p-channel transistor 56*p* when its gate is pulled low by power supply voltage $V_{dd}$ ramping low, and also through the tanks or wells of transistors 54*p*, 56*p*. As before, transistor 44*p* is thus turned on, so that transistors 42*p*, 44*p* also precharge node TO from power supply voltage $V_{dd}$. At this time, no conduction is occurring through any of the current mirror legs of bandgap reference circuit 10.

The following discussion is presented for the case where no active pulse is received on line RID. In this event, transistor 48*p* remains on, and transistor 50 remains off. As such, node TO continues to track power supply voltage $V_{dd}$ as it increases, by operation of transistors 48*p*, and the pair of transistors 42*p*, 44*p*. The relatively low voltage at capacitor 60 is applied to the gate of p-channel transistor 70 according to this preferred embodiment of the invention, however, turning on transistor 70. Transistor 70 thus applies the precharged power supply voltage $V_{dd}$, at node TO, to node NBIAS to turn on transistor 38*n* and to initiate conduction in the first current mirror leg of bandgap reference circuit 10. This conduction through transistor 38*n* is mirrored in the second and output legs of bandgap reference circuit 10, establishing the desired output reference voltage on line VREF even in the absence of a power-up indication pulse on line RID.

Once conduction begins through the current mirror legs of bandgap reference circuit 10, transistor 70 is eventually turned off so that the startup circuitry is isolated from bandgap reference circuit 10. As before, conduction through bandgap reference circuit 10 results in the setting of bias voltages on lines PBIAS1, PBIAS2 which are sufficient to at least partially turn on transistors 52*p*, 54*p*. With node TO remaining at power supply voltage $V_{dd}$ through transistor 48*p*, transistor 56*p* is held off. As such, the conduction through transistors 52*p*, 54*p* will charge capacitor 60 toward power supply voltage $V_{dd}$, which will turn off transistor 70 and isolate node TO from node NBIAS, permitting free operation of bandgap reference circuit 10.

Figure 3:
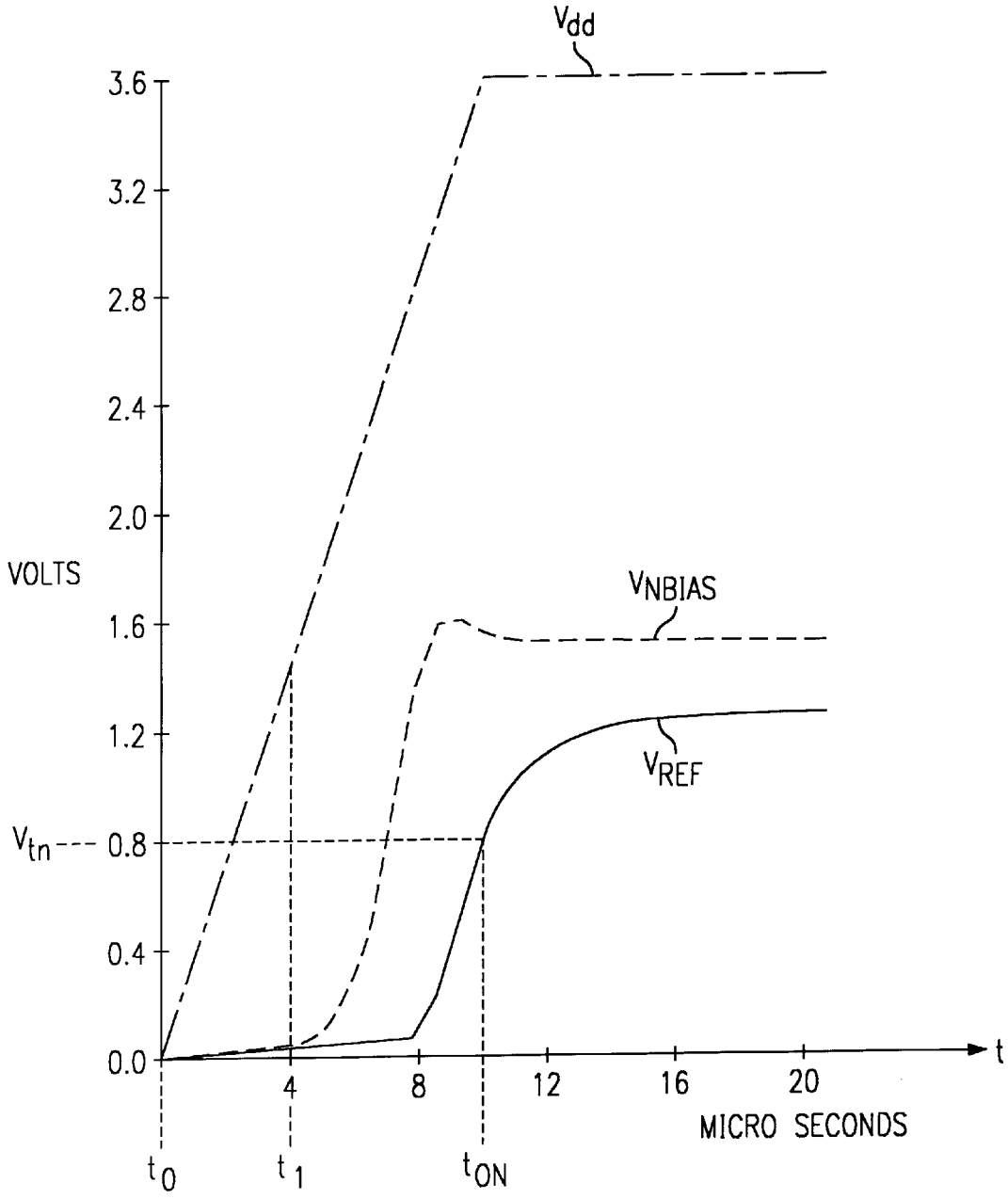
FIG. 3 is a timing diagram illustrating the operation of the circuit of FIG. 2 according to the preferred embodiment of the invention.

FIG. 3 illustrates a worst case simulation of the operation of an exemplary implementation of the circuitry of FIG. 2 according to the preferred embodiment of the invention, in initiating bandgap reference circuit 10 in the absence of an active pulse on line RID.

As described above, capacitor 60 is precharged to a voltage that is at or near ground prior to power-up of power supply voltage $V_{dd}$; this voltage at capacitor 60 also appears at the gate of transistor 70. Beginning at time $t_0$ of FIG. 3, power supply voltage $V_{dd}$ is powered up in a ramped fashion from ground toward its eventual level. In the absence of a pulse on line RID, transistor 48*p* is turned on, such that the ramping power supply voltage $V_{dd}$ is applied to node TO via transistor 48*p*; transistors 42*p*, 44*p* (transistor 44*p* being turned on by the relatively low voltage at capacitor 60) also assist in this biasing of node TO. At time $t_1$, power supply voltage Vdd reaches a level that exceeds the voltage at capacitor 60 by the threshold voltage of transistor 70, turning on transistor 70 and thus applying the voltage at node TO to node NBIAS. As shown in FIG. 3, voltage $V_{NBIAS}$ at node NBIAS thus begins to charge up toward power supply voltage $V_{dd}$ after time $t_1$, with the charging rate determined by the load at node NBIAS (which includes the cumulative gate capacitance of transistors 28*n*, 38*n* plus the capacitance of common mode rejection capacitor 39) in combination with the drive capability of transistor 70, as biased by the voltage at capacitor 60.

At time $t_{ON}$ in FIG. 3, voltage $V_{NBIAS}$ reaches the threshold voltage of transistor 38*n* (illustrated as voltage $V_{tn}$ in FIG. 3), turning on transistor 38*n* and initiating conduction through the first current mirror leg of bandgap reference circuit 10. Once this conduction initiates, bandgap reference circuit 10 quickly establishes the output reference voltage on line VREF (as shown in FIG. 3); voltage $V_{NBIAS}$ also quickly reaches its steady state, as determined by bandgap reference circuit 10, at this time. In addition, bandgap reference circuit 10 also quickly establishes bias voltages PBIAS1, PBIAS2, turning on transistors 52*p*, 54*p*, and rapidly charging capacitor 60 to power supply voltage $V_{dd}$. This turns off transistors 44*p* and 70, as described above.

As evident in the simulation of FIG. 3, the circuitry of FIG. 2 according to this embodiment of the invention is capable of initiating the operation of bandgap reference circuit 10 relatively quickly; for example, $t_{ON}$ in the exemplary realization shown in FIG. 3 occurs at approximately 10 μsec after the initiation of power-up. This turn-on time, as noted above, may be selected through sizing of transistor 70 and capacitor 60, relative to the load at node NBIAS; it is contemplated that those of ordinary skill in the art having reference to this specification will be readily able to optimize such selection for a particular implementation. Furthermore, it is contemplated that the circuitry according to this embodiment of the invention can also rapidly establish a reference voltage on line VREF in the event of a brief power-down and power-up sequence, again in the absence of a power-up pulse on line RID.

In this regard, it is contemplated that the startup circuitry according to this embodiment of the present invention may be provided so as to provide the exclusive manner in which bandgap reference circuit 10 is started up, thus eliminating the need for generating a power-up indication signal (line RID) and the need for associated startup circuitry (inverters 51, 53, 55 and transistor 50) if desired. It is contemplated, however, that since other circuitry in the integrated circuit may wish to utilize the power-up indication signal on line RID, and since this signal, when generated, may permit the more rapid firing of bandgap reference circuit 10, that most implementations of the present invention may be used as backup to the usual initiation sequence, as shown in FIG. 2.

The present invention therefore provides important advantages in ensuring operation of a reference voltage circuit in an integrated circuit upon power up, even in the absence of a power-up indication signal. As a result of the present invention, proper operation of the integrated circuit is ensured in this event, and indeterminate, erroneous, and unstable conditions are avoided. The present invention also facilitates its efficient realization within conventional integrated circuits, and as such may be readily implemented by way of minimal revision to existing integrated circuit layouts.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

We claim:

1. A voltage reference circuit, comprising:

a current mirror, comprising:

a first conduction leg having a plurality of transistors with current paths connected in series between a power supply voltage and a reference voltage, the first conduction leg having a first transistor with a control electrode connected to a startup node; and an output leg having a plurality of transistors having current paths connected in parallel with said plurality of transistors of said first conduction leg, and having an output node at which an output voltage is generated;

a first startup transistor, having a conduction path coupled on one side to the power supply voltage and connected on another side to the startup node, and having a control electrode;

a capacitor, having a first plate connected to the control electrode of the first startup transistor, and having a second plate biased to the reference voltage; and a discharge transistor having a current path connected in parallel to the capacitor, for discharging the capacitor upon power-down of the power supply voltage.

2. The voltage reference circuit of claim 1, further comprising:

a capacitor charging circuit, coupled to the power supply voltage and to the first plate of the capacitor, for charging the capacitor toward the power supply voltage responsive to current being conducted through the current mirror.

3. The voltage reference circuit of claim 1, wherein the current mirror further comprises:

a second conduction leg, coupled to the first conduction leg and to the output leg, the second conduction leg having a second transistor with a control electrode connected to the startup node.

4. The voltage reference circuit of claim 3, wherein the first conduction leg further comprises:

at least one field-effect transistor of a first conductivity type, having a source/drain path connected in the first conduction leg and having a control electrode; and a first bipolar transistor, having an emitter-collector conduction path connected in the first conduction leg and having a base electrode biased to the reference voltage;

wherein the first transistor is a field-effect transistor of a second conductivity type, having a source/drain path connected in the first conduction leg and having its control electrode connected to the startup node and to the drain of the first transistor;

wherein the second conduction leg comprises:

at least one field-effect transistor of the first conductivity type, having a source/drain path connected in the second conduction leg and having a control electrode connected at a node in the second conduction leg and also connected to the control electrode of a corresponding field-effect transistor of the first conductivity type in the first conduction leg; and a second bipolar transistor, having an emitter-collector conduction path connected in the second conduction leg and having a base electrode biased to the reference voltage;

wherein the second transistor is a field-effect transistor of the second conductivity type, having a source/drain path connected in the second conduction leg;

and wherein the output leg comprises:

at least one field-effect transistor of the first conductivity type, having a source/drain path connected in the output leg and having a control electrode connected to the control electrode of corresponding field-effect transistors of the first conductivity type in the first and second conduction legs; and a third bipolar transistor, having an emitter-collector conduction path connected in the output leg and having a base electrode biased to the reference voltage; and a resistor divider connected in series in the output leg.

5. The voltage reference circuit of claim 4, further comprising:

a capacitor charging circuit, coupled to the power supply voltage and to the first plate of the capacitor, for charging the capacitor toward the power supply voltage responsive to current being conducted through the current mirror.

6. The voltage reference circuit of claim 5, wherein the capacitor charging circuit comprises:

at least one field-effect transistor of the first conductivity type, having a source/drain path coupled between the power supply voltage and the first plate of the capacitor, and having a control electrode connected to the control electrode of a corresponding field-effect transistor of the first conductivity type in the first conduction leg.

7. The voltage reference circuit of claim 6, wherein the at least one field-effect transistor of the first conductivity type in the capacitor charging circuit corresponds to the discharge transistor, and is also for discharging the capacitor upon power-down of the power supply voltage.

8. The voltage reference circuit of claim 1, further comprising:

a precharge transistor, having a conduction path connected between the power supply and the conduction path of the first startup transistor, and having a control electrode coupled to a power-up indication signal in such a manner that the precharge transistor is turned on responsive to the power-up indication signal indicating that the power supply voltage has not recently powered up.

9. The voltage reference of claim 8, further comprising:

a second startup transistor, having a conduction path connected between the conduction path of the precharge transistor and the startup node, and having a control electrode coupled to the power-up indication signal in such a manner that the precharge transistor is turned on responsive to the power-up indication signal indicating that the power supply voltage has recently powered up.

10. A method of initiating operation of a voltage reference circuit, the voltage reference circuit including a current mirror comprising a first conduction leg connected between a power supply voltage and a reference voltage, the first conduction leg having a first transistor with a control electrode connected to a startup node, and an output leg, coupled to the first conduction leg, and having an output node at which an output reference voltage is generated, the method comprising the steps of:

discharging a capacitor responsive to the power supply voltage being powered down;

upon power-up of the power supply voltage, precharging a node coupled to a first side of a conduction path of a first startup transistor, a second side of the conduction path of the startup transistor being connected to the startup node; and applying the discharged voltage of the capacitor to the control electrode of the first startup transistor to turn it on, in response to which current conduction begins in the first conduction leg of the current mirror.

11. The method of claim 10, further comprising:

turning off the first startup transistor responsive to current being conducted in the first leg of the current mirror.

12. The method of claim 11, wherein the turning off step comprises charging the capacitor toward the power supply voltage to a voltage sufficient to turn off the first startup transistor.

13. The method of claim 10, wherein the precharging step comprises:

applying the discharged voltage of the capacitor to the control electrode of a first precharge transistor to turn it on, the first precharge transistor having a conduction path coupled between the power supply voltage and the first side of the conduction path of the first startup transistor.

14. The method of claim 13, wherein the precharging step further comprises:

turning on a second precharge transistor responsive to the power supply voltage not having recently been powered-up, the second precharge transistor having a conduction path coupled between the power supply voltage and the first side of the conduction path of the first startup transistor.

15. The method of claim 10, further comprising:

responsive to detecting a recent power-up of the power supply voltage, turning on a second startup transistor, the second startup transistor having a conduction path connected in parallel with the conduction path of the first startup transistor.

* * * * *

UNITED STATES PATENT AND TRADEMARK OFFICE

CERTIFICATE OF CORRECTION

PATENT NO. : 6,191,644 B1
DATED : February, 20, 2001
INVENTOR(S) : Srinath et al.

It is certified that error appears in the above-identified patent and that said Letters Patent is hereby corrected as shown below:

On the left column of the cover sheet under "Filed Dec. 10, 1998", insert
--Related US Application Data.
Provisional Application No. 60/068,329 December 19, 1997--
Column1, after line 3, insert --This application claims priority under 35 USC § 119(e)(1) of provisional Application number 60/068,329 filed 12/19/97.--

Signed and Sealed this

Twelfth Day of June, 2001

*Attest:*

Nicholas P. Godici

*Attesting Officer*

NICHOLAS P. GODICI
*Acting Director of the United States Patent and Trademark Office*